US006680098B1

(12) United States Patent
Aakermann

(10) Patent No.: US 6,680,098 B1
(45) Date of Patent: Jan. 20, 2004

(54) SELF-ADHESIVE LABEL

(75) Inventor: Christian Aakermann, Lier (NO)

(73) Assignee: Etikett-Service AS, Lier (NO)

( * ) Notice: Subject to any disclaimer, the term of this patent is extended or adjusted under 35 U.S.C. 154(b) by 0 days.

(21) Appl. No.: 10/019,090

(22) PCT Filed: Jun. 27, 2000

(86) PCT No.: PCT/SE00/01354

§ 371 (c)(1),
(2), (4) Date: Dec. 19, 2001

(87) PCT Pub. No.: WO01/01377

PCT Pub. Date: Jan. 4, 2001

(30) Foreign Application Priority Data

Jun. 28, 1999 (SE) ..... 9902445

(51) Int. Cl.[7] ..... G09F 3/02

(52) U.S. Cl. ..... 428/40.1; 40/299; 40/310; 283/81; 283/98; 283/99; 428/41.7; 428/41.8; 428/42.1; 428/42.2; 428/42.3; 428/43; 428/201; 428/202

(58) Field of Search ..... 428/40.1, 41.7, 428/41.8, 42.1, 42.2, 42.3, 43, 201, 202; 283/81, 98, 99; 40/299, 310

(56) References Cited

U.S. PATENT DOCUMENTS 5,342,093 A * 8/1994 Weernink ..... 283/81
6,073,377 A 6/2000 Mehta ..... 40/638

FOREIGN PATENT DOCUMENTS

DE 196 50 720 A1 6/1998
DE 197 24 648 A1 12/1998
EP 0 463 193 A1 1/1992
WO 85/04602 A1 10/1985

* cited by examiner

*Primary Examiner*—Nasser Ahmad
(74) *Attorney, Agent, or Firm*—Davis & Bujold, PLLC

(57) ABSTRACT

The present invention relates to a self-adhesive label (1), designed to be adhered to and around a container by means of a self-adhesive layer (9') on the back (9) of the label. This layer is protected up to the time of its use by the use of a release film having a smooth contact layer. The label is fastened to the substrate starting with one of its ends (2), which on its outer side (10) is provided with a release area (11), obtained by printing a layer thereon. The central portion (3) of the label is provided with a text or the like printed thereon. The layer has a larger length than the circumferential dimension of the container and will consequently with its other end (4) overlap said one end and be fastened to it by said self-adhesive layer. Said other end has sections (5, 6), which can be torn off and are separated from each other by perforations (7, 8), to be attached to an injection device or the like. According to the invention the release area is a layer, which is broken up or is the label material itself on the outer side of said primary area (2), broken up in order to form a substrate and fastening surface, which can vary as to size and has a variable/determinable retaining ability as regards said other label end. The applied layer, which constitutes the release area, is made of a screen print ink through screen or silk printing and constitutes at least one portion of the release area, produced at the same time as and made of the same substance as the patterning of the label for the rest.

14 Claims, 7 Drawing Sheets

SELF-ADHESIVE LABEL

The present invention relates to a self-adhesive label.

FIELD OF THE INVENTION

Such labels are used e.g. on cans and bottles, which contain medical drugs. The label is fastened around such a container by means of a self-adhesive layer on its back, which layer up to this point of time has been protected by a release film having a smooth contact layer, which allows without hindrance a removal of and, if this is desired, a fastening of the label anew. The label is designed to be fastened to the substrate and this will start with the label end, which constitutes the primary area and which on its outer side is provided with a release area, which has properties, which are similar to the properties of said release film. Since the label has a length in the winding direction, which is larger than the circumferential dimension of the container, the label will, with its other end, constitute the secondary area, overlap said primary area and be fastened to this by means of said self-adhesive layer. The purpose of such an arrangement is to, subsequent to the fastening of the label at a later point of time, render possible a removal and a tearing off of one or several sections, which have been delimited by e.g. perforations and constitute said other label end. These sections, which thus have a self-adhesive layer on their back, are designed to be applied on e.g. an injection device, a case-book etc., the label contents comprising not only a container but e.g. some form of treatment equipment chain. Since the substrate on the containers may vary considerably, the purpose of said primary area is to obtain uniform conditions for the fastening and the release of said sections.

BACKGROUND OF THE INVENTION

Such a label is described in EP-A-0 463 193. The most important characterizing feature of this label is that said release layer solely is applied to the primary area and consists of a silicone finish, which has been applied through printing. The smooth release layer is limited to said primary area and said section covers solely the outer side of said primary area. The silicone finish is applied in a first printing step and the label is provided with a printed text of another substance in a second printing step. Thus, the label has to, by the manufacture, be subjected to at least two different printing steps, which is time consuming, require expensive equipment and is costly.

DE-197 24 648 A1 describes another label, which however is not similar to the label according to the preamble of claim 1 and with which special properties have been aimed at in cooperation with other labels in the form of blocks and rolls, namely for an automated release of separate labels from a block or a roll, to be applied on objects, which will be labelled. Since this type of label will exclude the use of a release film (so called linerless labels) and the separate labels in said block or roll form are exposed, with their upper side as well as their lower side, to adjacent labels, it has been suggested, that the downwardly turned as the upwardly turned anti-adhesive layer should be weakened by arranging them in a type of screen/raster and the latter layer with a certain raise or nap respectively. In this way the purpose has been to secure the release of separate labels from the block or roll form. Also, the purpose has been to make the labels writable on the side of or through the anti-adhesive or release layer, particularity when using a ball point pen or pincil. However, a raise or nap of at least 13 mm is necessary, preferably at least 21 mm, as well as an access to the label paper across the release layer (see col. 3, lines 38–44).

However, in all the labels shown in their entirety in the drawings of said latter specification, an adhesive and release layer, which covers the entire label surface, has not been used, and the foremost reason for this is, that a writing and a printing respectively across the release layer is not without problems and that the purpose is to write on portions of the upper side of the label in a satisfactory and durable way. Thus, special through central areas have been left free from a release layer (see FIGS. 4*a* and *b* as well as col. 12, lines 2–6), However, this has resulted in, that also the adhesive layer on the back of the label, which already has been weakened through the screen form, has obtained a corresponding limitation and consequently also an inferiority as regards an attachment to a substrate. Otherwise e.g. an adhesive layer, which completely would cover the label, in block or roll form would run the risk of getting stuck more or less permanently on the layer-less portions of the upper side of the underlying label, damaging these portions and the like, to which risk it has been referred to under the term "Verblockung" in several places in this specification.

Thus, the label material according to this specification at least partially is provided with a printing material, before the anti-adhesive layer is applied (see col. 4, lines 52–55). In this way a satisfactory adhesion of the print layer on the paper label or the paper layer of the label is obtained. However, it is generally considered to be objectionable and aesthetically less acceptable, when anti-adhesive agents are applied on top of printed portions, and even more so, when printed materials are applied on top of an anti-adhesive layer, which material will be unclear and run the risk of becoming obliterated.

To sum up, this known label will primarily:

a) be free from any release film;

b) have an upper side, which it is easy and reliable to release from an adjacent lower side of a label, c) have a lower label side, which easily and reliably will release the upper side of an underlying label; and d) be writable, particularly with a ball point pen or a pencil, despite or at the side of an applied anti-adhesive layer.

SUMMARY OF THE INVENTION

None of these objects coincide with the objects of the present invention, according to wich a release film will be used, no direct piling of labels on top of each other in any form is done, the adhesive layer is unbroken and covers the entire label and no subsequent writing on the label is contemplated.

Quite generally, it is difficult and impossible respectively to control the release properties of a silicone finish, particularly to obtain a reduced release ability and respectively to obtain desirable variation possibilities regarding control and adjustment of the adhesion/retaining and the release ability respectively, which may have to vary, when small as well as large containers are used and consequently a strongly varying bending radius exists, and the material properties of the labels and their thickness, the ambient temperature and the moisture condition, the ageing resistance etc. vary.

Another drawback may be, that the space for e.g. information texts and price markings, e.g. in the form av bar codes, may be very limited or does not exist, if the labels are small and used on small containers. Only the label material itself usually is not suitable as a substrate for the secondary area, since the adhesive ability often will be too strong, e.g. on paper labels. The thickness of the labels can play an important role in this, i.a. regarding the elimination of inherent tensions, when the labels are bent.

It has so far been difficult to control properties, which apparently counteract each other. Thus, the adhesive layer must adhere satisfactorily on the container substrate, which may have a strong release tendency, when it is made of glass or a plastic material or has a fatty film, an efficient adhesive substance being required, whereas such a quality of the adhesive substance is objectionable, if it results in inconveniences regarding the removal of said tearing-off section from the primary area. Since it is practically impossible to, on the same surface, apply two adhesives having different properties, the problem must be solved in another satisfactory and relible way, which so far has not been achieved.

The object of the present invention is to counteract and as far as possible eliminate the above-mentioned invonveniences. Another object of the invention is to develop the state of the art in this field and to make possible a quicker, simpler and more reliable production and use of such labels as well as to develop new secure ways to handle the labels and achieve quality results.

These objects are attained according to the invention by designing a label of the type described in the introduction mainly in such a way, as is set forth in the characterizing clause of claim 1. Whereas the release layer according to the German specification is broken, partly in order to let through ink or pencil lead particles and partly to allow a reliable release from another label during a labelling procedure, the release layer according to the present invention is designed to guarantee a satisfactory fastening and release of portions of one and the same label as well as to make the label production more economical, more uniform and simpler. In the known case the label is provided with a release layer, print and writing respectively in two or three consecutive steps. According to the present invention these two or three steps are summed up in just one step, since the release layer at the same time belongs to the printing of the label for the rest. According to the invention a release film is a necessary component. The release surface of the release film and the release area of the label can have release properties, which differ from each other. Also, the release film has en important advantage, because the individual labels can be arranged free from each other and it is not necessary to make them stick together via e.g. perforations, which must meet the somewhat contradictory requirement to reliably keep the entire label strip together as well as to allow a simple, quick and reliable release of individual labels. To optimize these two requirements is a very difficult task. However, according to the present invention it is not difficult at all to optimize the release film and the labels each one for their specific purposes. The adhesive layer according to the present invention is itself not broken up and it covers the entire back of the label. Its adhesion ability will be selected within the maximal area. There is no need to take into consideration the release from adjacent labels during a labelling procedure for any of the two layers according to the invention. The adhesive layer will adhere maximally to the substrate, which often has inferior retaining properties, i.e. glass or a plastic material. Thus, the purpose of the release layer according to the invention is to partly make its application more economical by designing it as an active part of the print application and partly to control the removability of the tearing-off section of the label. To attain the latter purpose there is no need for any preparation for additional print application or writability. Since labels according to the invention primarily or actually exclusively must be designed to be used on medical containers, a guarantee for a faultless accomplishment of the intended functions is enormously important. A loosening of a label from a shoe box, some kind of gift article and a lot of other objects may result in loss of time because of a new labelling or the like. The looseing of a label from a medical container often may become a matter of life and death. Consequently, the characterizing features according to the main claim or the rest of the claims are extremely important, However, almost as important as that an unintentional loosening must not take place is the fact, that the intentional release of the sections, which can be teared off, must take place without any problems and that this can be done from different types of objects, e.g. bottles having a large radius of curvature and consequently less tensions built into the applied label and bottles having a small radius of curvature and relatively large built-in tensions because of this. In the first case the efficient surface of the release area can be kept relatively limited, whereas in the last-mentioned case this surface must be large in proportion to the total surface of the release area, and whereas it should also be taken into consideration, to what extent a small radius of curvature will assist in the removability of said section.

The label according to the invention can be made of an arbitrary material and a mate-rial combination respectively. A plastic material or at least a layer of a plastic mate-rial is a preferred material, e.g. polypropylene. In this way a material is obtained, which is compact in its surface and is strong for the rest, in contrast to what is preferred according to said German specification. The plastic material has controllable inherent tensions unlike paper, because the properties of a paper material, the directions of its fibers, its temperature, its moisture etc. can be of significant and crucial importance. Also, the plastic material is suitable for a clear printing, particularly if the size of the text is very small, and other types of marking. Also, the label can in such a case arbitratrily be made translucent and opaque respectively. Also, the recycling can become uniform, provided the containers are made of the same material as the labels.

Additional characterizing features and advantages of the present invention are set forth in the following description, reference being made to the enlosed drawings, which schematically show a few preferred but non-limiting embodiments and in which in detail:

DETAILED DESCRIPTION OF THE INVENTION

Figure 1:
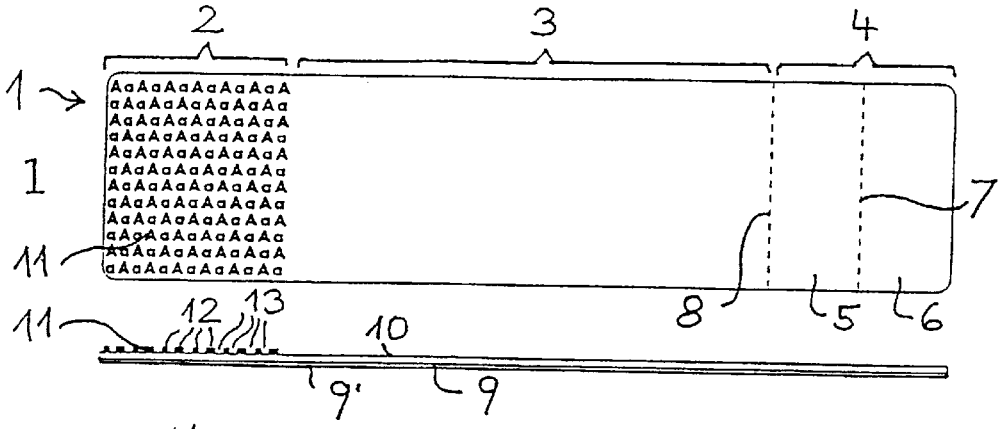
FIGS. 1–4 show four different designs of labels according to the invention in planar views, from above/from below and in a lateral direction, the lateral views showing the raises strongly exaggerated in order to elucidate the invention more fully.

In the drawings the same or similar parts are designated with the same reference numerals. Thus, a label according to the invention is in its entirety designated with 1. This label can be designed in an arbitrary way, e.g. provided with a handle portion, be made of any suitable material, e.g. a plastic material and/or paper, and consists of a primary end 2, a central portion 3 and a secondary end 4. The latter is divided into e.g. two sections 5 and 6, which are separated from each other and said central portion 3 respectively by means of perpendicular perforations 7 and 8.

Back 9 of the label is in its entirety provided with a preferably maximally functioning, unbroken self-adhesive layer 9', which only is shown in FIG. 1, but this is of course true for all other embodiments, and which up to its time of application is covered by a not shown protective or releasable film. The application is carried out in such a way, that, when the protective film has been removed, the primary end is attached firstly to the outer side of a not shown container, e.g. made of a glass or a plastic material. The circumferential dimension of the container is not larger than the total length of label portions 2 and 3. Subsequently central portion 3 is wound around the container and finally secondary end 4 with its back will form-complementarily end up on the front or outer side of primary end 2. In case the lenghts of the labels are considerable, the central portion can be folded up, which is known. Then, subsequent to the primary end suitably firstly the secondary end is attached to the former, and then the center portion with its folding up is applied.

The entire front or outer side 10 of the label can per se be provided with release properties, i.e. render possible the removal of particularly secondary end 4, but it is particularity within the area of said primary end 2 provided with a special release area 11 having special material properties, structural properties and specific production ss well as possibly usage properties. Release area 11 is provided with these special properties by producing it by means of silk screen ink, the production suitably being carried out by means of silk screen printing and at the same time the production of possibly additional letters and/or images/symbols on the remaining portion of the label and of the same substance as in the latter case. Alternatively and/or in addition to this said special properties can be obtained by cutting out the label material itself within release area 11 according to a certain pattern or by embossing it with a die, a punch or the like. It is common for all the alternatives, that a non-homogenous or broken surface is formed, in which the rises and recesses respectively of the ink and the label material and the label material without rises and recesses respectively interact in order to obtain a release and a retaining respectively, which can be controlled or set within wide margins by using different material properties and the actual surface area within the release area. The surface layer of the label material and its silk screen ink can then have different release and retaining properties respective-ly, an additional means of variation being obtained. Also, the label material itself can be influenced within the release area, e.g. by raising (napping) it or smoothing it out in order to increase and reduce the retaining ability respectively.

Figure 2:
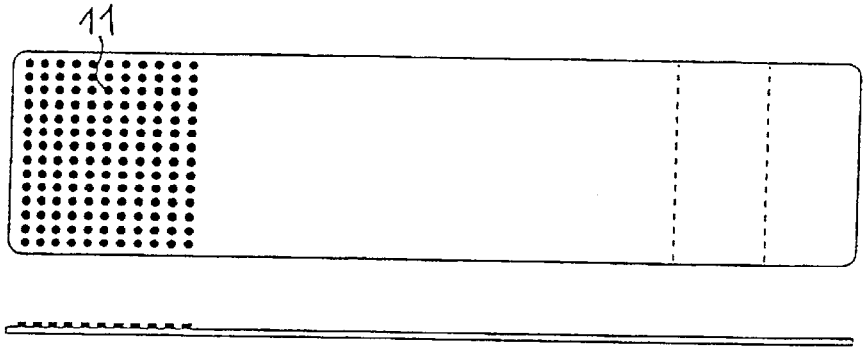
Figure 4:
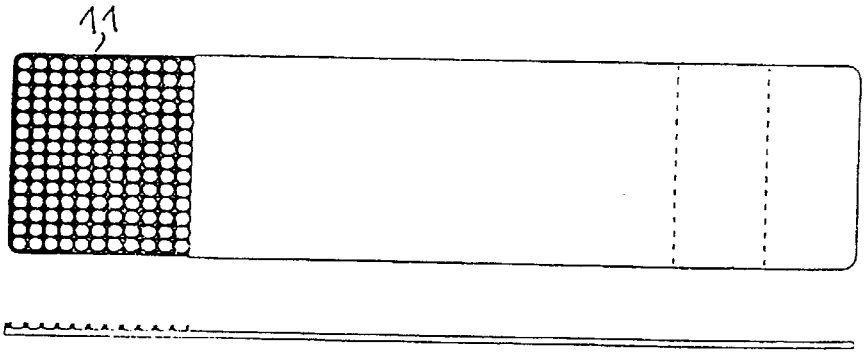

The broken surface on the outer or front side of release area 11 is provided with, as is shown in an exaggerated and thereby elucidating way in the attached drawings, rises 12 and recesses or possibly cut-outs 13. The thickness or the hight of said rises is 10–200 mm, preferably 20–30 mm, and is provided in practice for the adhesive property in connection with the planar extension. On comparison between e.g. the patris pattern (obtained by punching) according to FIG. 2 and the matis pattern (obtained by dies) according to FIG. 4, it is evident, that in the first case percentage-wise a larger contact is obtained with the label material itself than with the point-like rises of silk screen ink, whereas the situation is the opposite in the latter case. In this regard in addition to the adhesion properties of the label material and the silk screen also the planar extension of the recesses and possible cut-outs play a role and also the height of the rises. In case the latter is relatively large, whereas the distance between adjacent rises is relatively small, it is difficult or impossible for the adhesion layer to adhere to the bottom of the recesses. In case said height is relatively small, whereas the distance between adjacent rises is relatively large, it is easy for the adhesive layer to adhere to the bottom of the recesses and in this way increase the total actual retaining surface within the primary area.

Figure 3:
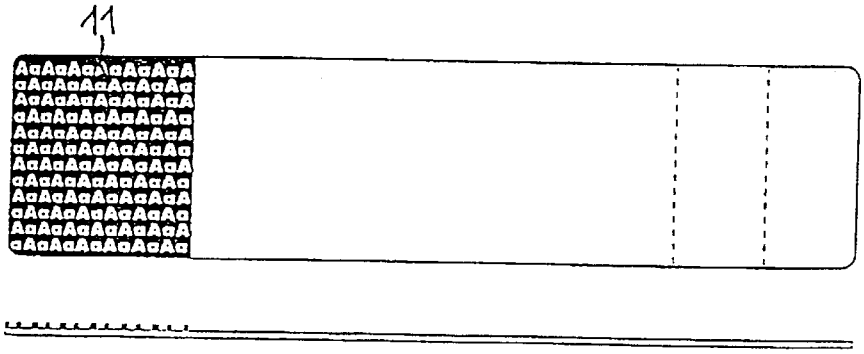

In this way an excellent and very advantageous instrument has been developed, designed to determine, control and vary the release and the retaining ability respectively within the primary or the release area, between 100% of what is typical for the silk screen ink and respectively 100% of what is typical for the label material and a situation without any contact, particularly when cut-outs are provided, arbitrary variations being provided therebetween. These variations are obtained primarily through the nature, the density and the total surface share of the rises within the release area. FIGS. 1 and 3 only roughly and exemplifying show, how, by using patris and matris patterns, it is possible to use a text (letters) in the release area, whereas FIGS. 2 and 4 roughly show various possible figure or symbol characters. In this case a double function is obtained, namely, in addition to the attainment of certain desirable release and retaining abilities, the provision of information in the form of text and/or images/symbols.

Figure 5:
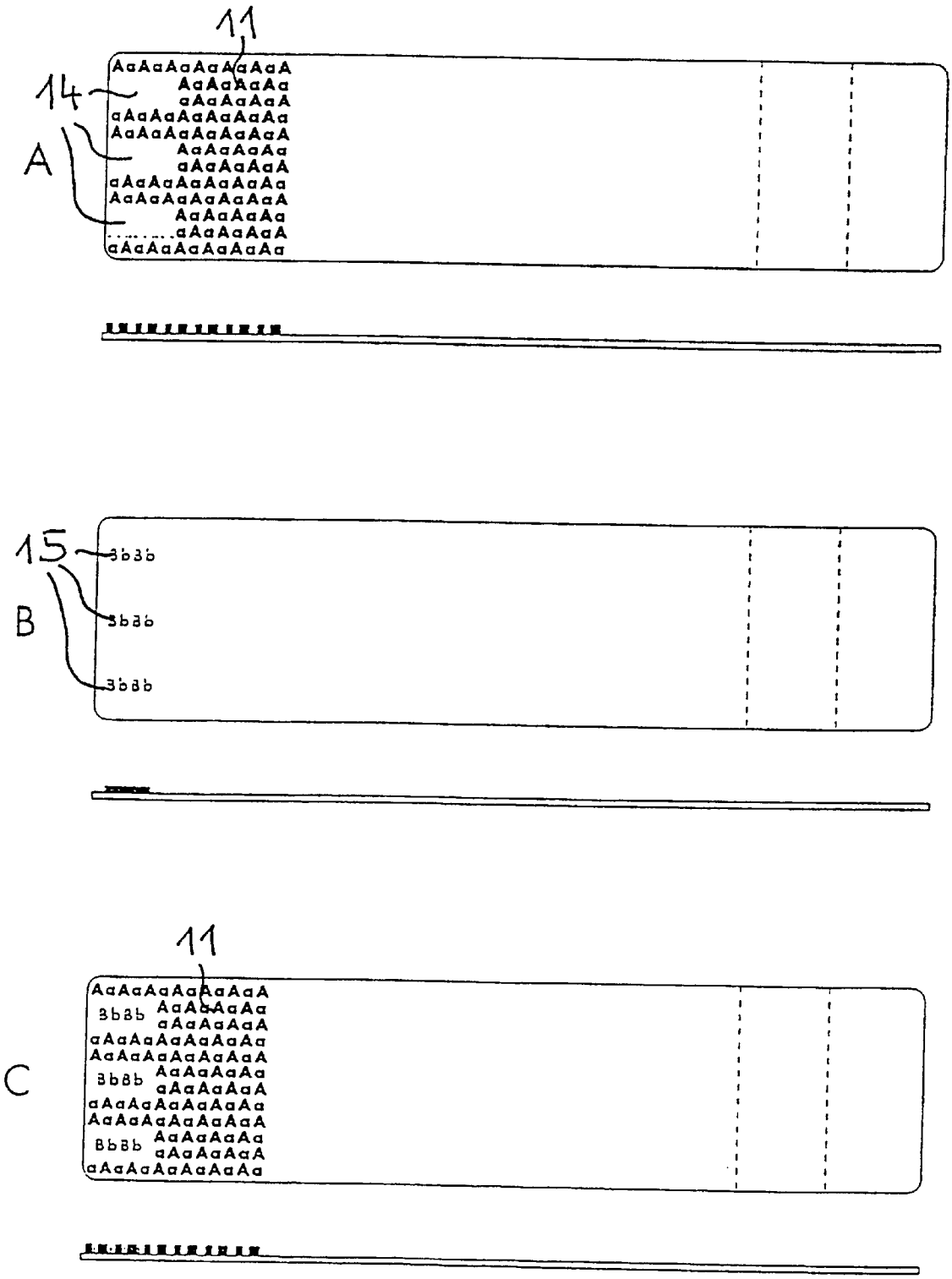
FIGS. 5–10 show, in the same manner as that shown in FIGS. 1–4, six additional modified label designs according to the invention, in which consecutive production steps, which can be carried out after each other in one and the same operation, are shown in the form av views A, B and C.

The embodiment according to FIG. 5 show, that it is possible in a first phase A to pro-vide the release area with e.g. a text having cleared free areas 14, in which in a subsequent phase identification elements 15 are included, e.g. a text, which only can be made visible through infra-red lighting or at a certain high temperature, after a certain storage time etc. In this way it is e.g. possible to meet a certain codifying requirement to provide a date marking for the production time and/or the last day of con-sumption or to have the label manufacturer produce the label in phase A, whereas e.g. a drug manufacturer will supplement the label with phase B, the applied label obtai-ning the appearance according to C.

Figure 6:
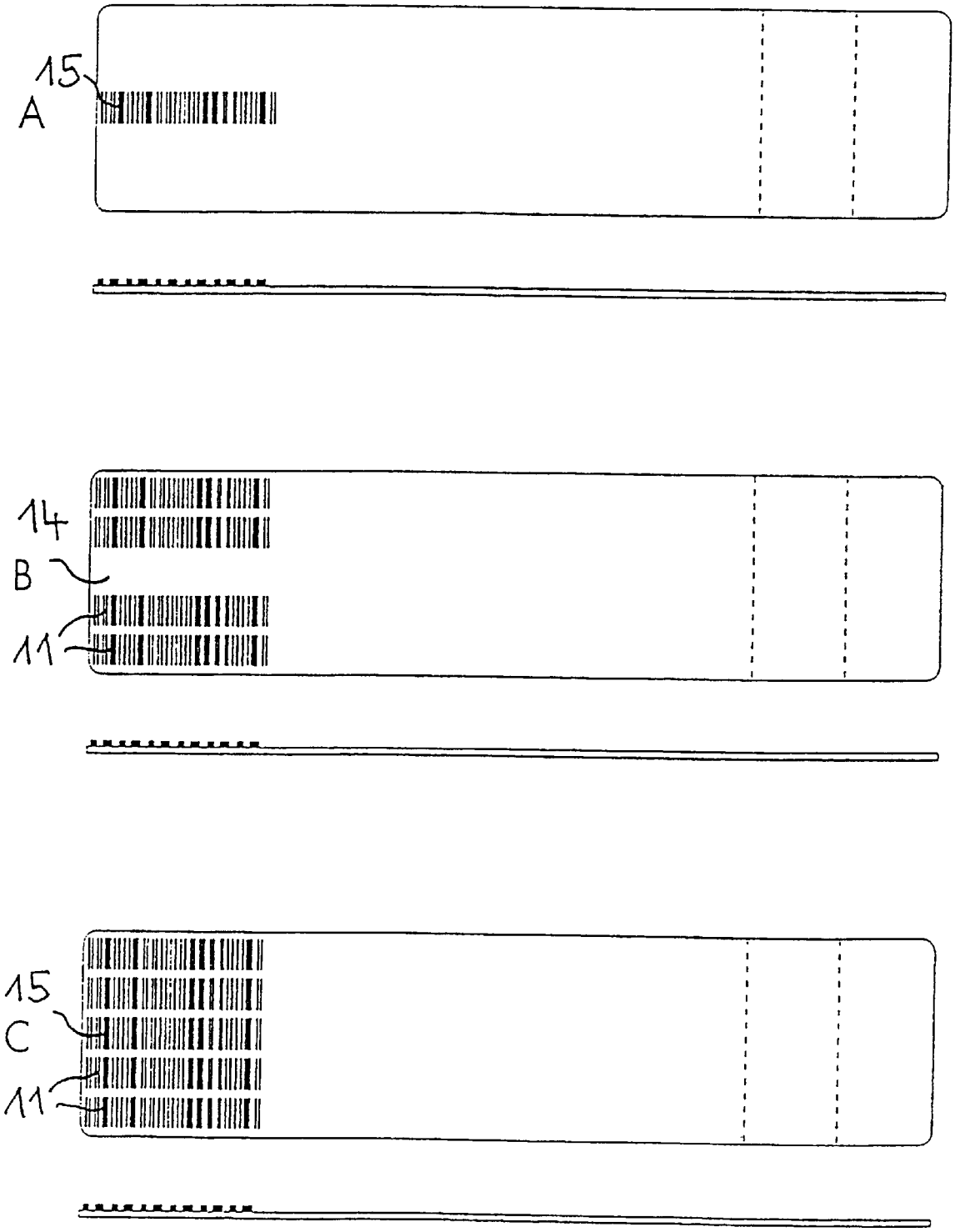
Figure 7:
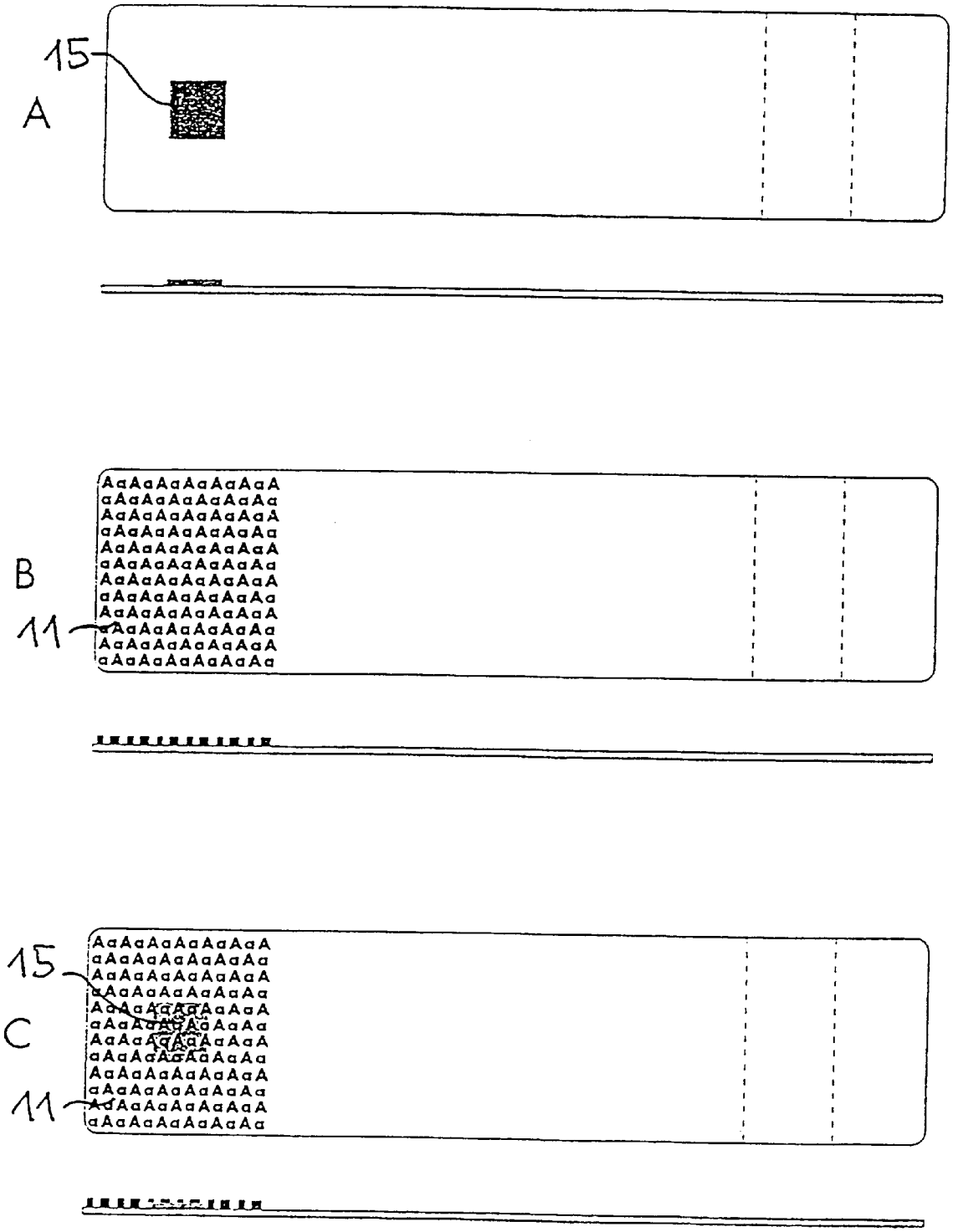

The embodiment according to FIG. 6 shows in a similar way as in FIG. 5, that it is possible to use bar codes for marking purposes, whereas FIGS. 7–10 indicate suggestions to various hologram markings, FIG. 7 showing the application of a central hologram field in phase A, whereas an overlapping text or the like is applied in phase B, an appearance according to C being obtained.

Figure 8:
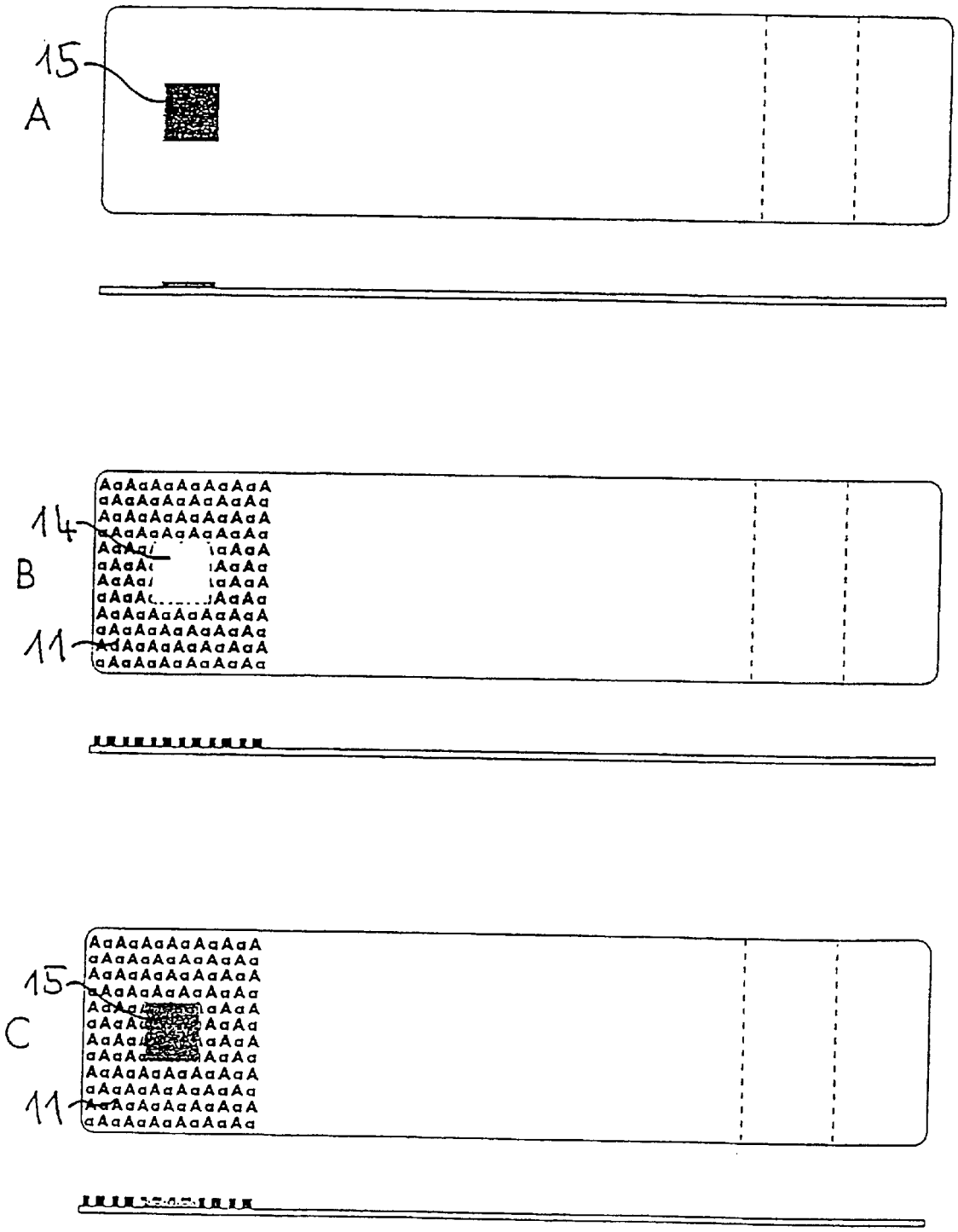

FIG. 8 is similar to the embodiment according to FIG. 7, but the text portion or the like according to B has a clearance, designed to include the hologram share. Thus, in C there is no overlapping.

Figure 9:
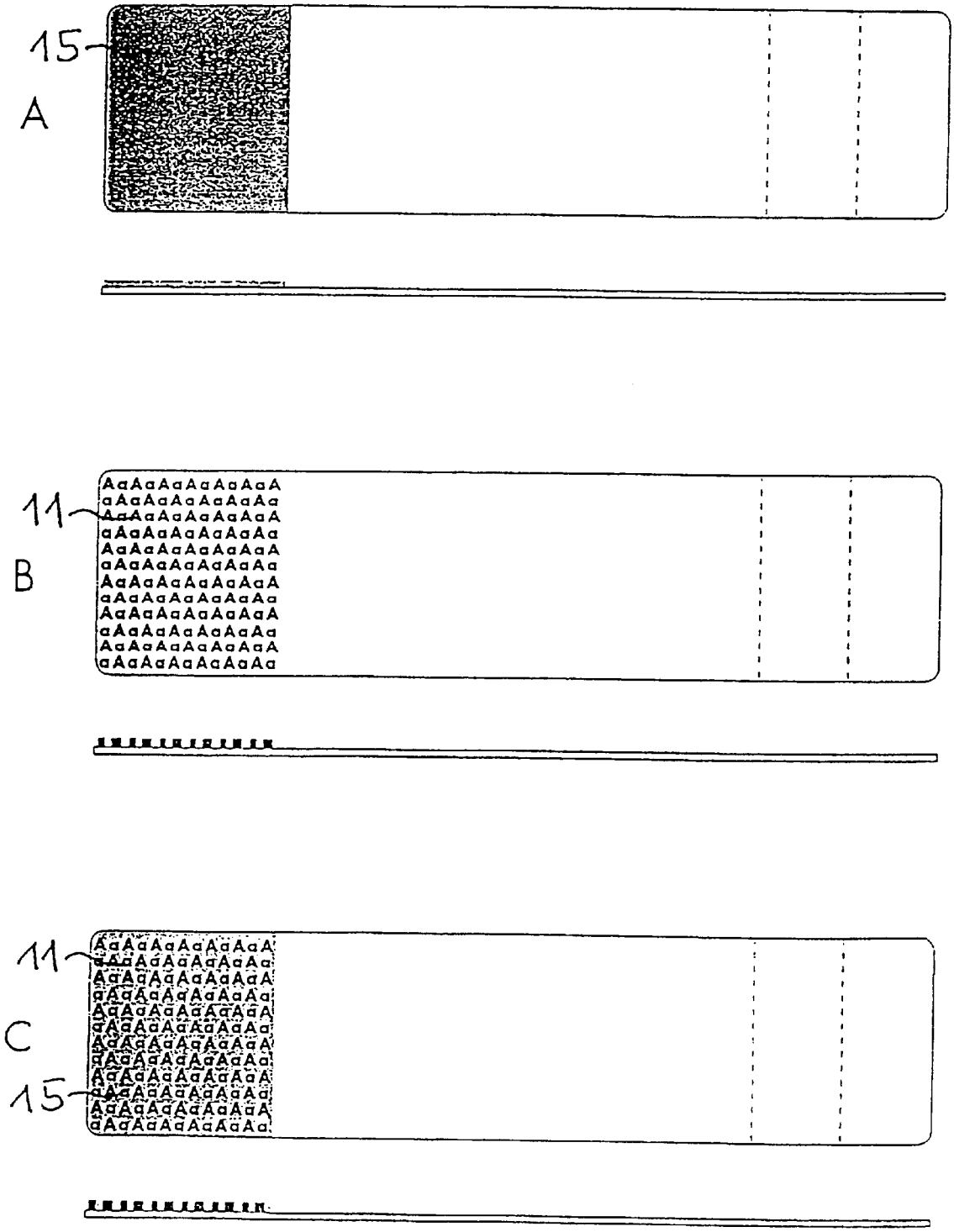

FIG. 9 is similar to the embodiment according to FIG. 7, but the hologram field covers the entire release area and the text or the like according to B in phase C overlaps the hologram portion.

Figure 10:
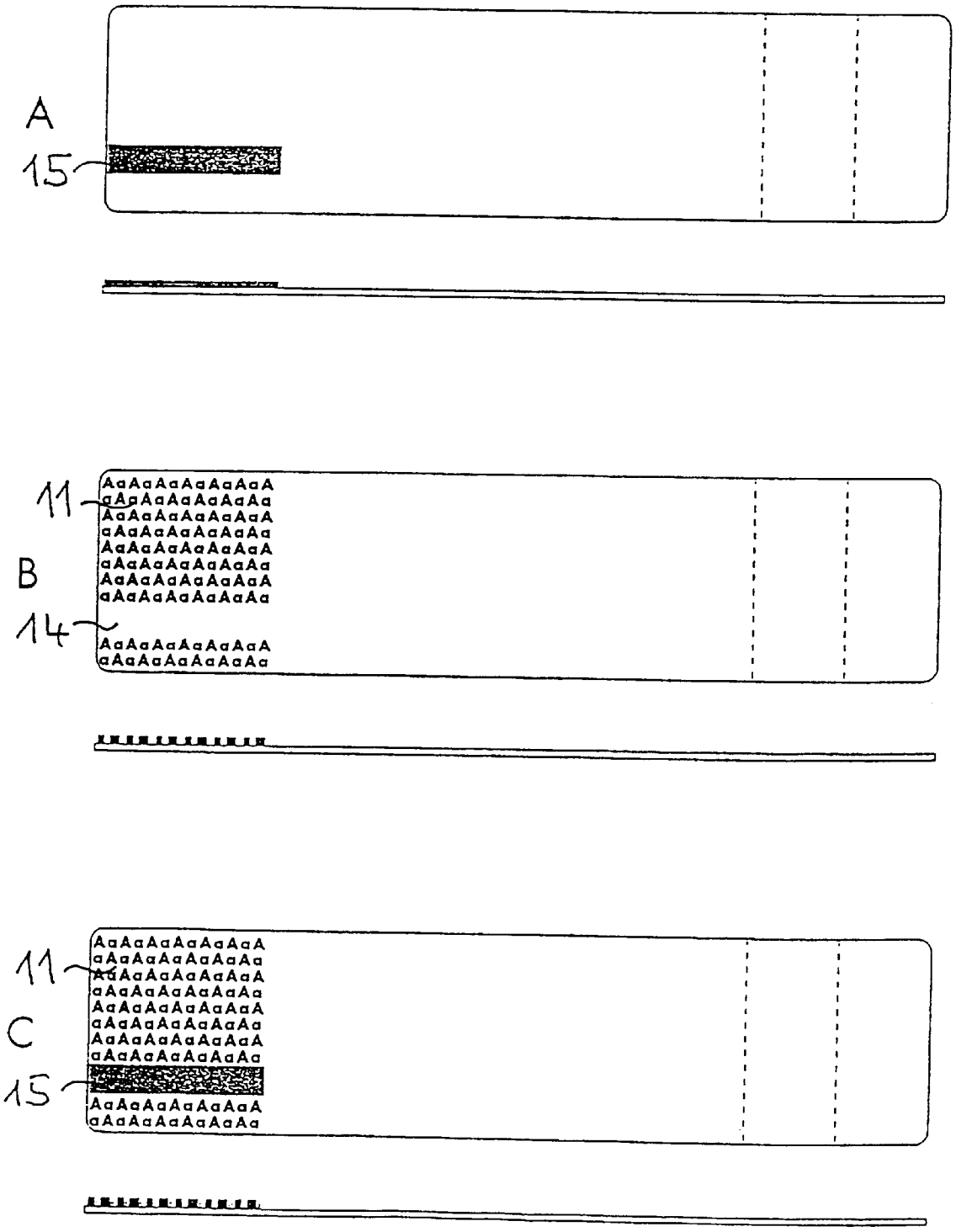

FIG. 10 is similar to the embodiment according to FIG. 8, and the hologram portion has in this case a bar code form, which fits into a clearance in the text or the like.

The present invention is not limited to the embodiments described above and/or shown and indicated respectively in the enclosed drawings, which only are to be seen as non-limiting embodiments, which can be modified and supplemented in arbitrary ways within the scope of the inventive idea and according to the accompanying claims.

What is claimed is:

1. A self-adhesive label (1) to be applied to a container, the self-adhesive label comprising:

a homogenous, unbroken self-adhesive layer (9') applied to a backside of the label (1) to adhere the label (1)

around the container, the self-adhesive layer (9') being initially covered by a first release film having a smooth contact layer to permit removal of the release film from the self-adhesive layer (9') and application of the label to the container;

a length longer than a circumference of the container, the length being defined by a first end portion (2) of the label designed to be directly adhered to the container by the self-adhesive layer (9') on the backside, a central portion (3), and a second end portion (4) for overlapping and being releasably adhered to a release area (11) on a frontside of the first end portion (2) by the self-adhesive layer (9') on the backside of the second end portion (4);

at least one removable section (5, 6), which can be torn off via perforations (7, 8) to be adhered to another object; and wherein the release area comprises a second release film comprising a plurality of topographic rises and recesses corresponding to a design formed by a layer of silk screen printing ink applied to the frontside of the first end portion (2) of the label.

2. The label according to claim 1, wherein the thickness of the layer of silk screen printing ink which constitutes the release area (11), is between about 10–200 mm.

3. The label according to claim 1, wherein the design formed by the layer of silk screen printing ink which constitutes the release area (11) comprises at least one of text, symbol and bar code.

4. The label according to claim 1, wherein the frontside of the first end portion (2) of the label is provided with a holographic image layer for special security control underneath the design formed by the layer of silk screen printing ink applied to the frontside of the first end portion (2) of the label.

5. The label according to claim 1, wherein the release area (11) is embossed with at least one of a matris and patris pattern.

6. The label according to claim 1, wherein the layer of silk screen printing ink which defines the release area (11) is arranged to have at least a cleared free area (14), and a separate element (15) is provided in the cleared free area (14) which solely can be made visible by infra-red lighting or when a certain temperature is reached or when the label have been stored a certain time in order to meet a certain codifying requirement, a product date marking requirement and/or a requirement to set forth the last date of consumption or for a basic production of the label in a first step (A) and a later completion of it in a second step (B).

7. The label according to claim 1, wherein the layer of silk screen printing ink which defines the release area (11) at least partially consists of one of a bar code marking, a hologram marking and desired text having a different height relative to the layer of print defining the release area.

8. The label according to claim 1, wherein the layer of silk screen printing ink defining the release area (11) comprises raised portions (12) and recessed portions (13), the height of the raised portions being defined according to a desired retaining ability of the secondary area (4) in order to obtain a larger or a smaller contact surface in relation to the label material itself.

9. A self-adhesive label (1) to be applied to a container, the self-adhesive label comprising:

a label body having a back side and an opposing front side defining a length divided into a first end portion, a center portion and a second end portion;

an adhesive provided on substantially the entirety of the back side of the label body;

a removable release film for covering the adhesive on the back side of the label;

a contact area provided on the front side of the first end portion of the label body for permitting adherence and release of the adhesive coated back side of the second end portion when the label body is cylindrically engaged with itself; and wherein the contact area comprises a plurality of topographic rises and recesses formed on the front side of the label body to obtain a desired release and retention force between the contact area on the front side of the label and the adhesive on the back side of the label.

10. The self-adhesive label (1) as set forth in claim 9 wherein the topographic rises are provided by a raised layer of silk screen print ink provided on a surface of the front side of the label body defining the topographic recesses.

11. The self-adhesive label (1) as set forth in claim 10 wherein the raised layer of silk screen print ink defines at least a first surface having a different release and retention force relative to the surface of the front side of the label body defining the topographic recesses.

12. The self-adhesive label (1) as set forth in claim 11 wherein the raised layer of silk screen print ink defining the first surface comprises substantially the same materials as the removable film for covering the adhesive on the back side of the label.

13. The self-adhesive label (1) as set forth in claim 12 wherein the release and retention force between the contact area and the adhesive is varied according by one of increasing and decreasing the first surface area relative to the surface of the front side of the label body defining the topographic recesses.

14. A self-adhesive label (1) to be applied to a container, the self-adhesive label comprising:

a label body having a back side and an opposing front side defining a length divided into a first end portion, a center portion and a second end portion;

an adhesive provided on substantially the entirety of the back side of the label body;

a removable release film for covering the adhesive on the back side of the label;

a contact area provided on the front side of the first end portion of the label body for permitting adherence and release of the adhesive coated back side of the second end portion when the label body is cylindrically engaged with itself;

the contact area comprises a plurality of topographic rises and recesses in the label body to obtain a desired release and retention force between the contact area on the front side of the label and the adhesive on the back side of the label and the topographic rises are provided by a raised layer of silk screen print ink provided on a surface of the front side of the label body defining the topographic recesses; and wherein the raised layer of silk screen print ink defines at least a first surface having a different release and retention force relative to the surface of the front side of the label body defining the topographic recesses and the raised layer of silk screen print ink defining the first surface comprises substantially the same materials as the removable film for covering the adhesive on the back side of the label and the release and retention force between the contact area and the adhesive is varied according by one of increasing and decreasing the first surface area relative to the surface of the front side of the label body defining the topographic recesses.

* * * * *